US009435127B2

(12) United States Patent
Stoyanov

(10) Patent No.: US 9,435,127 B2
(45) Date of Patent: Sep. 6, 2016

(54) CONSTRUCTION PROFILE, CONSTRUCTION SET, CONSTRUCTION PROFILE KIT AND FIXING SYSTEM FOR VENTILATED CLADDINGS

(71) Applicant: STOA OOD, Sofia (BG)

(72) Inventor: Damian Vassilev Stoyanov, Sofia (BG)

(73) Assignee: STOA OOD, Sofia (BG)

( * ) Notice: Subject to any disclaimer, the term of this patent is extended or adjusted under 35 U.S.C. 154(b) by 0 days.

(21) Appl. No.: 14/403,152

(22) PCT Filed: Apr. 9, 2013

(86) PCT No.: PCT/BG2013/000016

§ 371 (c)(1),
(2) Date: Nov. 21, 2014

(87) PCT Pub. No.: WO2013/173887

PCT Pub. Date: Nov. 28, 2013

(65) Prior Publication Data

US 2015/0167314 A1 Jun. 18, 2015

(30) Foreign Application Priority Data

May 22, 2012 (BG) ..... 111211

(51) Int. Cl.
*E04B 1/38* (2006.01)
*E04F 13/22* (2006.01)
(Continued)

(52) U.S. Cl.
CPC ..... *E04F 13/22* (2013.01); *E04F 13/0805* (2013.01); *E04F 13/0807* (2013.01); *E04F 13/0825* (2013.01); *E04F 13/0826* (2013.01); *E04F 13/24* (2013.01)

(58) Field of Classification Search
CPC .... E04B 2/88; E04B 2/60; E04B 2001/2475; E04B 2001/2451; E04F 13/072; E04F 13/081; E04F 13/22; E04F 13/24; E04F 13/0805; F16B 7/187; F16B 7/0433
USPC ..... 52/282.2
See application file for complete search history.

(56) References Cited

U.S. PATENT DOCUMENTS 2,866,235 A * 12/1958 Couse et al. ..... 52/475.1
3,159,250 A * 12/1964 Wilson ..... 52/301
(Continued)

FOREIGN PATENT DOCUMENTS

DE 102004020626 A1 11/2005
JP H07197540 A 8/1995
(Continued)

OTHER PUBLICATIONS

International Search Report for International Application No. PCT/BG2013/000016, dated Nov. 21, 2013.

*Primary Examiner* — Brian Mattei
*Assistant Examiner* — Gisele Ford
(74) *Attorney, Agent, or Firm* — Marshall, Gerstein & Borun LLP

(57) ABSTRACT

A construction profile (1) with a polygonal cross-section and edge portions provided with slots formed between adjacent polygon faces (7) and extending in an inclined direction relative thereto, a construction profile kit with said construction profile and joint profiles, and an fixing system for ventilated claddings with a supporting frame of construction profiles (1). The fixing system further comprises a supporting element (21) for supporting a frame profile (1) to a facade (87) and a holding plate (26) for holding facade plates (83), the elements (21, 26) being formed so as to be slid longitudinally or plugged circumferentially into the slots (5) of the construction profile (1).

16 Claims, 9 Drawing Sheets

(51) Int. Cl.
*E04F 13/08* (2006.01)
*E04F 13/24* (2006.01)

(56) References Cited

U.S. PATENT DOCUMENTS

| | | | | | |
|---|---|---|---|---|---|
| 3,490,800 | A * | 1/1970 | Wissler | 52/586.2 | |
| 3,559,357 | A * | 2/1971 | Lowe | 52/282.4 | |
| 3,782,048 | A * | 1/1974 | Corman | 52/282.2 | |
| 4,071,990 | A * | 2/1978 | Traber | 52/155 | |
| 4,458,455 | A * | 7/1984 | Tollstoff de Voss | 52/38 | |
| 4,532,747 | A * | 8/1985 | Koetje | 52/586.1 | |
| 4,583,359 | A * | 4/1986 | Staeger | 52/653.2 | |
| 4,621,938 | A * | 11/1986 | Weilow | E04B 1/2403 | 211/182 |
| 5,265,972 | A * | 11/1993 | Bahr | 403/252 | |
| 5,484,068 | A * | 1/1996 | Huang | A47B 57/045 | 211/193 |
| 5,513,475 | A * | 5/1996 | Schaaf et al. | 52/606 | |
| 5,609,435 | A * | 3/1997 | Nomura | 403/387 | |
| 5,651,630 | A * | 7/1997 | Nomura | 403/219 | |
| 5,678,383 | A * | 10/1997 | Danielewicz | 52/775 | |
| 5,864,997 | A * | 2/1999 | Kelly | 52/282.2 | |
| 5,921,052 | A * | 7/1999 | Kemp | A47B 13/06 | 52/831 |
| 6,004,182 | A * | 12/1999 | Pasin | 446/105 | |
| 6,185,887 | B1 * | 2/2001 | Strassle | A47B 57/045 | 403/231 |
| 6,250,025 | B1 * | 6/2001 | Darby | E04H 13/006 | 52/137 |
| 6,682,255 | B2 * | 1/2004 | Battaglia et al. | 403/381 | |
| 6,764,245 | B2 * | 7/2004 | Popovski | 403/256 | |
| 7,976,257 | B2 * | 7/2011 | Kufner | 411/84 | |
| 8,065,847 | B2 * | 11/2011 | Gimpel et al. | 52/309.1 | |
| 2004/0033103 | A1 * | 2/2004 | Ludwig | E04B 9/14 | 403/188 |
| 2005/0129458 | A1 * | 6/2005 | Hoffmann | 403/256 | |
| 2005/0260032 | A1 * | 11/2005 | Band et al. | 403/252 | |
| 2006/0110215 | A1 * | 5/2006 | Holscher | 403/253 | |
| 2006/0179788 | A1 * | 8/2006 | Nicoletti | 52/741.15 | |
| 2008/0148684 | A1 * | 6/2008 | Bruder | 52/764 | |
| 2008/0313983 | A1 * | 12/2008 | Hawes | E04C 3/005 | 52/282.2 |
| 2009/0000235 | A1 * | 1/2009 | Kieran et al. | 52/656.9 | |
| 2010/0006518 | A1 * | 1/2010 | Brobst | 211/26 | |
| 2010/0229496 | A1 * | 9/2010 | Munakata et al. | 52/705 | |
| 2011/0000146 | A1 * | 1/2011 | Takeda et al. | 52/79.1 | |
| 2011/0258812 | A1 * | 10/2011 | Oetlinger | 16/382 | |
| 2012/0125870 | A1 * | 5/2012 | Decroos et al. | 211/26 | |
| 2013/0034383 | A1 * | 2/2013 | Chong | E04B 1/24 | 403/231 |
| 2015/0010343 | A1 * | 1/2015 | Flaig | B23P 19/04 | 403/188 |
| 2015/0052840 | A1 * | 2/2015 | Beaty | E06B 1/34 | 52/483.1 |

FOREIGN PATENT DOCUMENTS

| | | | |
|---|---|---|---|
| JP | 2002047643 | A | 2/2002 |
| WO | WO-2011046312 | A2 | 4/2011 |

* cited by examiner

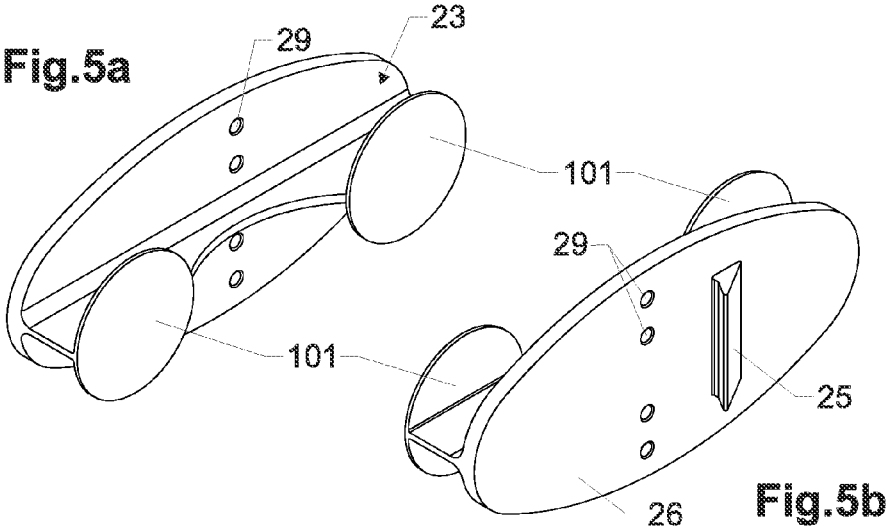
Fig.5a
Fig.5b
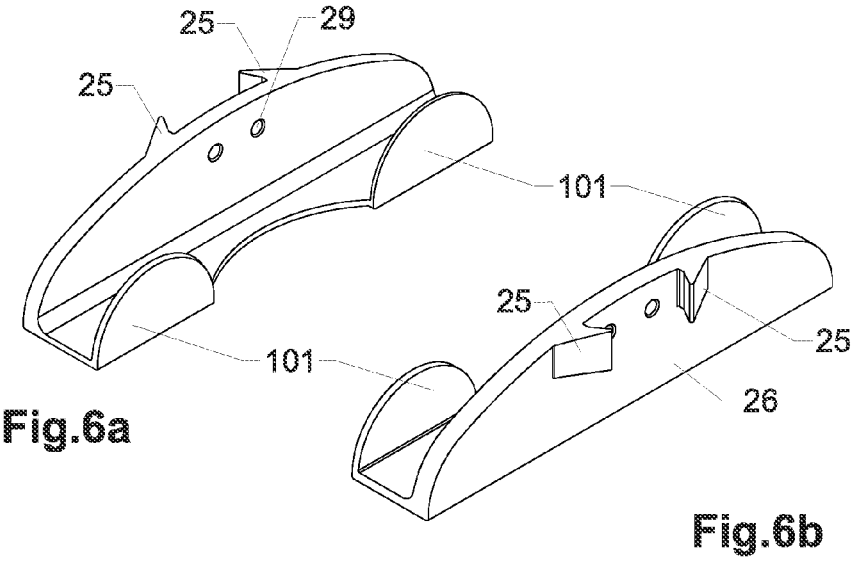
Fig.6a
Fig.6b

CONSTRUCTION PROFILE, CONSTRUCTION SET, CONSTRUCTION PROFILE KIT AND FIXING SYSTEM FOR VENTILATED CLADDINGS

CROSS-REFERENCE TO RELATED APPLICATION

The present application is the US national phase of International Patent Application No. PCT/BG2013/000016, filed Apr. 9, 2013, which application claims priority of Belgium Application No. 111211, filed May 22, 2012. The priority application, BG 111211, is hereby incorporated by reference.

TECHNICAL FIELD

The invention relates to a construction profile, a construction set, a construction profile kit and a fixing system for ventilated claddings.

BACKGROUND ART

Document WO 2009/074346 A2 discloses a construction profile with a polygonal cross-section according to and a fixing system comprising the construction profile.

EXTENDED DESCRIPTION OF THE INVENTION

A problem to be solved by the present invention is to improve a construction profile with respect to its stability and usability as a construction element can be mounted quickly or receive parts to be mounted on it. This problem is solved by a construction profile with a polygonal cross-section comprises edge portions being provided with slots formed between adjacent polygon faces and extending in an inclined direction relative thereto. The advantage of having slots at the edge portions is that the slots are located at the farthest point from the center of the construction profile. Thereby the supporting polygon face in-between the slots is maximized.

Particularly advantageous is a construction profile each slot of which is formed as a recess with an outer insert portion and an inner bottom portion. This way supporting or holding elements can be guided into the slots for a distance, which is predetermined by the shape of either the outer insert portion or the shape of the bottom portion with regard to the element to be mounted on the construction profile.

A further advantageous modification is one where the insert portion is formed as a taper with the bottom portion forming an undercut behind the narrow end of the taper. Such slots offer a detachable attachment of parts onto the profile or of the profile onto compatible structures. Moreover, such slots can serve as guides for parts that are adapted to be slid into the slots from one of the longitudinal ends of the profile.

Preferably, the bottom portion of the slots has a circular shape in order to resemble together with the outer insert portion a keyhole such as required for the establishment of a key and slot joint.

According to another preferred modification the bottom portions of the slots are provided with at least one longitudinal recess capable of accommodating chip or splitter caused by the fastening of self-cutting screws in the bottom portions of the slots at the longitudinal ends of the profile.

According to a particularly advantageous embodiment the construction profile according to the invention is formed as a hollow profile comprising a contour wall with straight portions forming the polygon faces and clip-like folded portions forming the slots. The weight of such a profile is significantly decreased, while the clip-like folded portions reinforce the construction profile.

For a better functioning of the slots as clips it is preferable when the wall thickness of the bottom portion is lower than the wall thickness of the adjacent taper and faces. Thus, the wall of the bottom portion can serve as a hinge when supporting or holding elements are clicked-in from the circumference of the profile through the insert portion or have to be removed from the bottom portion through the insert portion.

Because of their length and constant cross-section construction profiles according to the invention are preferably obtained by extrusion. As for materials, aluminum or polymers are preferably suited for the purpose, because they are generally lightweight and at the same time stiff enough to ensure the structural integrity of the construction profile.

A further problem solved by the present invention is to further develop a construction set comprising a construction profile and a supporting and/or a holding element to be attached to the profile, said construction set being improved with respect to its stability and usability and allowing for a quick and versatile mounting. This problem is solved by a construction set comprising a construction profile with a polygonal cross-section and a plurality of edges with at least one slot formed in the edge portion of the profile, and a holding or supporting element being able to engage with the slot while fitting with at least one face of the profile next to the edge which face does not comprise the slot. Such a set enables the use of holding or supporting elements having large plain, "L"-shape or "U"-shape mounting faces fitting with corresponding profile mounting faces for a better stability. Further, the set according to the invention allows the use of different possible shapes of the holding or supporting elements for achieving a variety of construction arrangements, which in the end benefits the overall usability of the construction set.

Preferably, the supporting or holding element of the construction set has two engaging portions being able to engage with slots separated by a polygonal face extending there between. This way the supporting or holding element can be mounted on the construction profile without the need for additional fastening elements such as screws.

Further preferable is a construction set with a construction profile that is one of the above described construction profiles according to the invention. By this arrangement the advantages of the improved construction profile are integrated into the construction set.

It is advantageous that each face of the profile comprises two slots each formed along and close to one of the edges confining the face. In other words, each face has two slots at its distant ends. This allows for multiple combinations between the respective elements of the construction set and also ensures that one whole polygonal face can be used for fitting with the holding or supporting element to be attached to the profile.

Another problem solved by the present invention is the provision of a construction profile kit allowing for a quick, precise and stable construction of profile frames. Such a construction profile kit comprises hollow construction profiles and joint profiles being formed so as to be inserted in an end of a respective hollow construction profile and get in abutment with the inner sides of at least two opposite wall faces of the hollow construction profile. Through such a system various construction profiles can be put together to a desired length.

It is particularly preferable if the joint profile is formed such as to get in abutment with each of the inner sides of the wall faces of the hollow construction profile.

Particularly advantageous is if one of the described joint profiles is capable of abutting at least one of the inner sides of the hollow construction profile while it further abuts the inner walls of slots formed on both ends of said one inner side.

A further problem solved by the present invention is the provision of a fixing system for ventilated facades having improved stability, mounting versatility and allowing for a fast and easy assembly and maintenance. This problem is solved by a fixing system comprising a supporting frame of construction profiles described above. Such fixing system preferably comprises holding elements for holding facade plates and supporting elements for supporting the frame to a facade, these elements being formed so as to be slid or plugged (clicked-in) into the slots of the construction profiles. The versatility of such a fixing system results from the circumstance that holding and supporting elements can assume a plurality of various mounting positions on the profiles.

Preferably, the fixing system comprises brackets that receive the supporting elements and are formed so as to be anchored to a facade. This arrangement allows for an easy replacement of the supporting elements while the brackets anchored to the facade remain in place.

Particularly advantageous is a fixing system, wherein the holding and/or supporting elements comprise at least one elongated projection that is capable of engaging with one of the slots of the construction profile. The projection can serve to align the holding and/or supporting elements to the construction profiles during installation.

The fixing system preferably has supporting elements comprising two elongated projections to be slid and/or plugged (clicked-in) into the slots of a construction profile so as to enable a positive locking. Two projections offer an increased safety of the connection between such a supporting element and the construction profile.

It is advantageous that the elongated projection of the holding element has a tooth-like cross-section fitting only with the tapered opening of the slots of the construction profile. This way the elongated projection can be manufactured with generous tolerances with regard to its length, because it can reach to just the beginning of the tapered opening of the slot or all the way to the bottom portion wall of the slot. Also, special care is not necessary when mounting, since the arrangement is self-guiding.

The above fixing system preferably comprises two construction profiles connected by a joint profile fitted in adjacent end portions of these profiles which share one supporting element attached to these end portions. Such an arrangement potentially minimizes the number of supporting elements necessary for the assembly of a supporting frame made of the construction profiles.

BRIEF DESCRIPTION OF DRAWINGS

FIG. 5 Embodiment of a holding element used in the construction set and the fixing system according to the invention (FIGS. 5*a* and 5*b*).

FIG. 6 Another embodiment of a holding element used in the construction set and the fixing system according to the invention (FIGS. 6*a* and 6*b*).

DETAILED DESCRIPTION OF PREFERRED EMBODIMENTS

Figure 1:
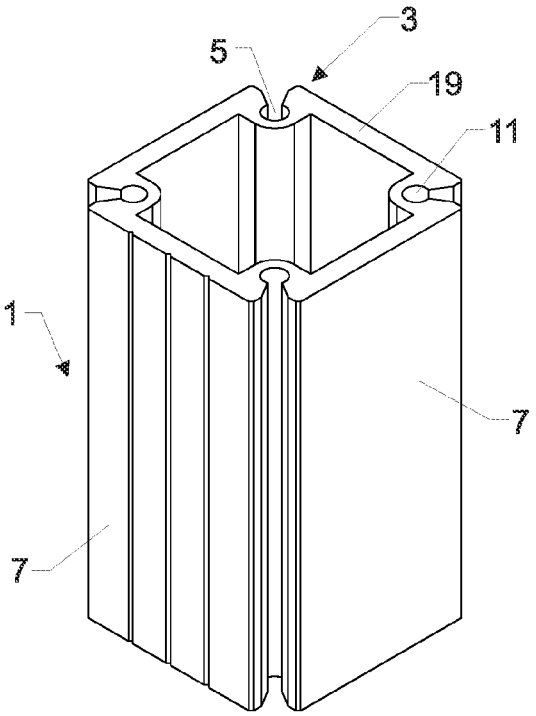
FIG. 1A construction profile according to the invention.
Figure 2:
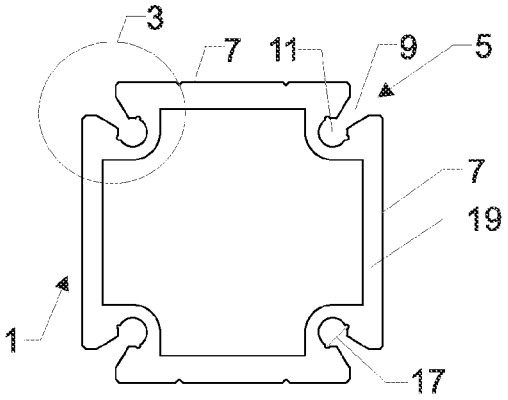
FIG. 2 Section view of the construction profile shown in FIG. 1.

As shown in FIG. 1 a construction profile 1 according to one embodiment of the present invention comprises edge portions 3 being provided with slots 5 formed between adjacent polygon faces 7 and extending in an inclined direction relative thereto as particularly illustrated by FIG. 2. The advantage of having slots at the edge portions 3 is that the slots are located at the farthest point from the center of the construction profile, whereby the area of fitting between the polygon faces of the profile and elements to be locked to the profile via the slots can be maximized.

Figure 3:
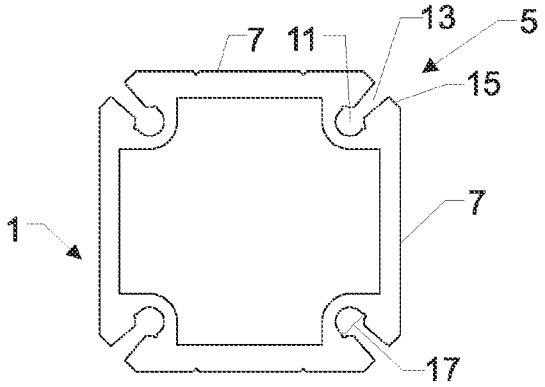
FIG. 3 Section view of a construction profile according to another embodiment of the invention.

In the particular embodiments shown in FIGS. 1 to 3 each slot 5 is formed as a recess with an outer insert portion 9 and an inner bottom portion 11. Here the insert portion 9 is particularly formed as a staggered double taper with the bottom portion 11 forming an undercut behind the narrow end of the taper. The staggered taper is particularly suitable for click-in fittings of elements to be locked or guided by the bottom portions 11. Such slots offer an easy detachable attachment of parts onto the profile or of the profile onto compatible structures.

The slots 5 of the profile embodiment shown in FIG. 2 are characterized by a circular bottom portion 11 which together with the pertinent outer insert portion 9 forms a kind of a keyhole cross-section of the slot which is particularly suitable for the establishment of key and slot joints easy to click together. Unlike the slot shown in FIG. 2, the insert portion 13 of the slot shown in FIG. 3 has the form of a single taper the opening of which extends in the plane of slanted corner face 15. The bottom portions 11 of the slots shown in each of FIGS. 2 and 3 are provided with two tiny longitudinal recesses 17 capable of accommodating chip or splitter caused by a longitudinal fastening of self-cutting screws in the bottom portions of the slots at the two ends of the profile 1.

As can be seen in each of the FIGS. 1 to 3 the construction profile according to these embodiments of the invention is formed as a hollow profile comprising a contour wall 19 with straight portions forming the plane polygon faces 7 and clip-like folded portions forming the slots 5. Thus, the weight of such a profile is significantly decreased, while the clip-like folded portions impart to the construction profile resilience and strength in the same time. In these embodiments, for a better functioning of the wall clips at the profile's corners forming the slots 5 the wall thickness at the bottom portions 11 is chosen lower than the wall thickness at the adjacent taper and faces 7. Thus, the wall of the bottom portion 11 can serve as a hinge when supporting or holding elements are clicked-in from the circumference of the profile through the insert portion or have to be removed from the bottom portion 11 through the insert portion 9, 13.

The construction profile 1 according to the embodiments shown in FIGS. 1 to 3 is obtained by extrusion of aluminum which allows achieving precisely constant cross-section of the profile along its length. As for materials also polymers are suitable because they are generally lightweight and at the same time stiff enough to ensure the structural integrity of the construction profile.

Figure 4:
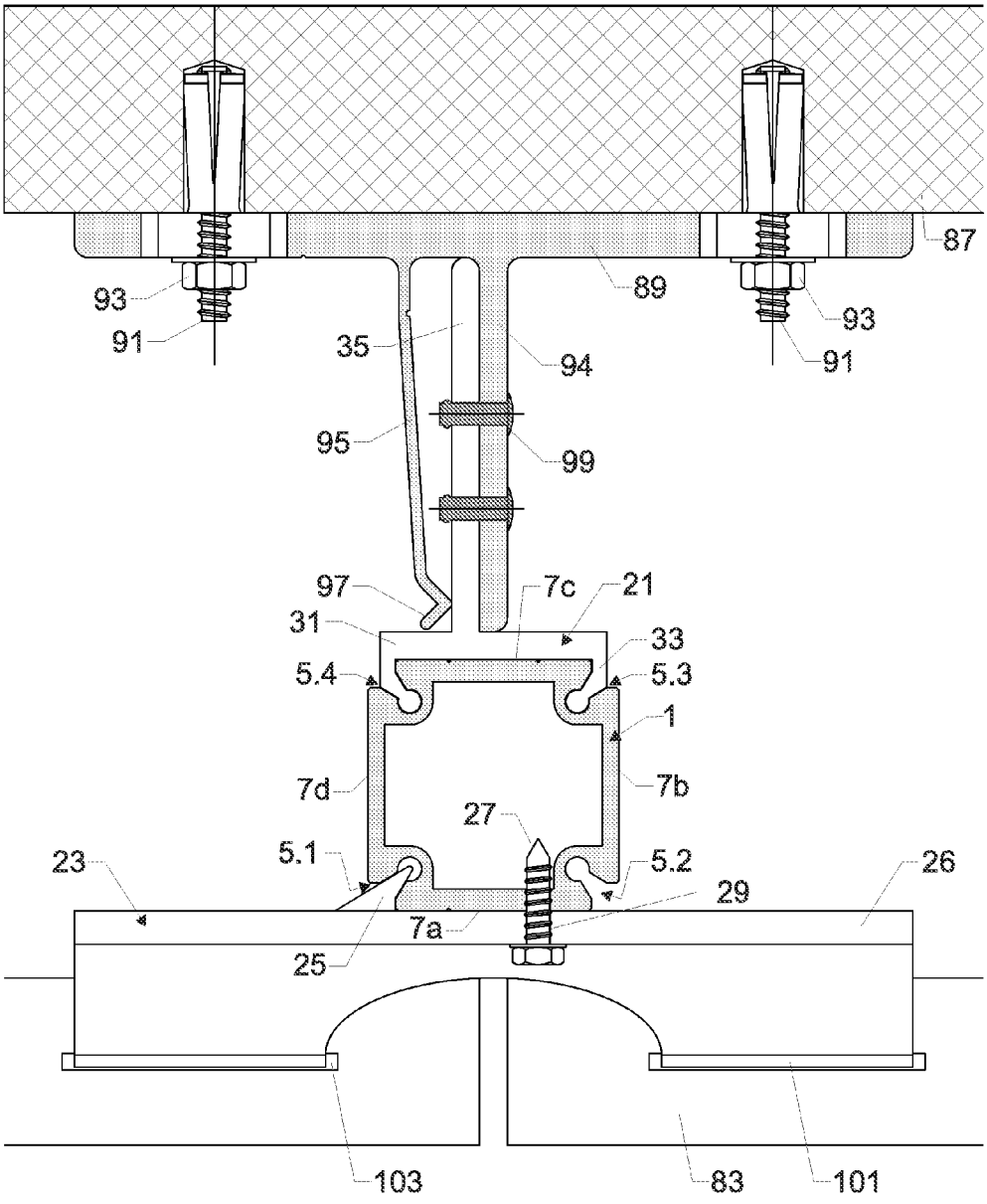
FIG. 4 Section view of an embodiment of a construction profile, a construction set and a fixing system according to the invention.

An embodiment of a construction set according to the present invention is shown in FIG. 4. Such a construction set basically comprises a construction profile 1 according to the embodiment shown in FIG. 2, as well as a supporting element 21 and a holding element 23 attached to the profile. The holding element 23 of this embodiment is provided with a tooth portion 25 which engages with a slot 5.1 of the profile while fitting with its holding plate 26 to a face 7*a* of the profile 1 extending next to the profile edge with the slot 5.1. The holding element 23 is fixed to the profile face 7*a* by self-cutting screws 27 which are guided by holes 29 drilled in holding plate 26 as shown by the isolated illustration of FIGS. 5*a* and 5*b*.

Figure 7:
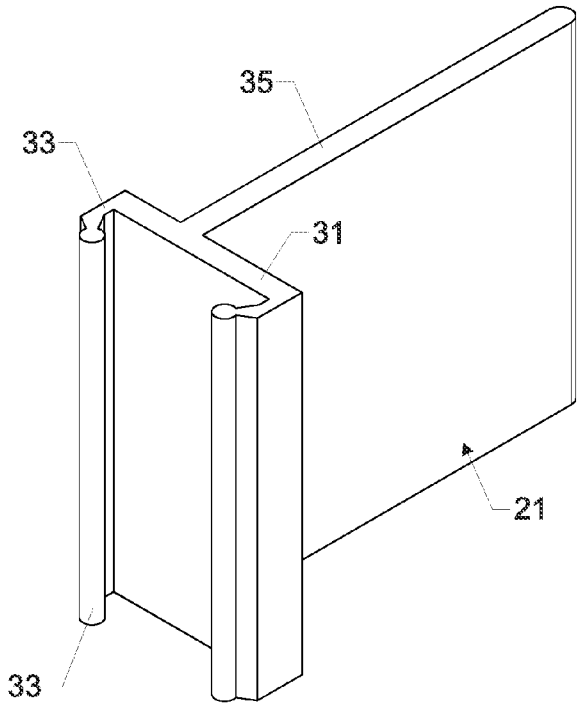
FIG. 7 Embodiment of a supporting element used in the construction set and the fixing system according to the invention.
Figure 10:
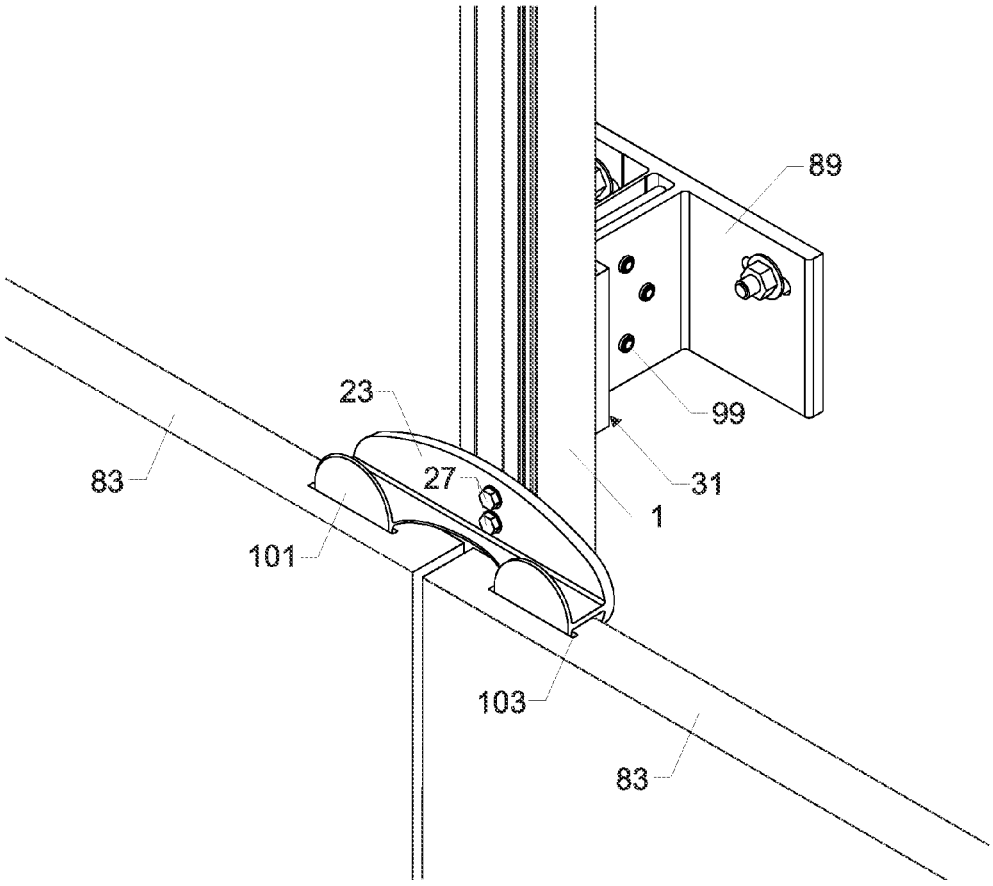
FIG. 10 Three-dimensional view of a construction profile, a construction set and a fixing system according to the invention.

As shown in FIGS. 4 and 7, the supporting element 21 has a T-shape with its shorter front plate portion 31 being provided at its opposite ends with two key portions 33 inserted in slots 5.3 and 5.4 formed at the two ends of the profile face 7*c* arranged opposite to the face 7*a*. The longer plate portion 35 serves as a connection to a building structure as shown in FIGS. 4 and 10.

Figure 11:
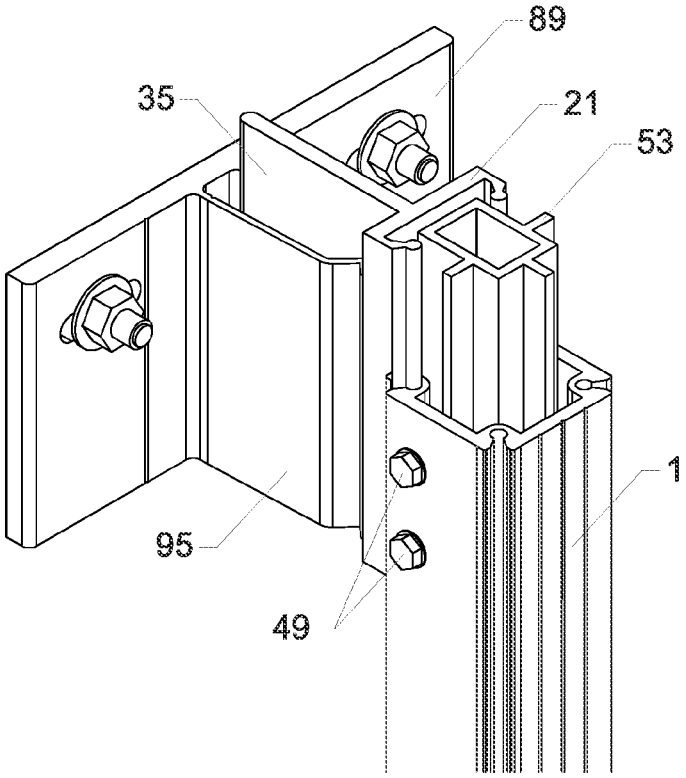
FIG. 11 Embodiment of a construction profile kit according to the invention.
Figure 12:
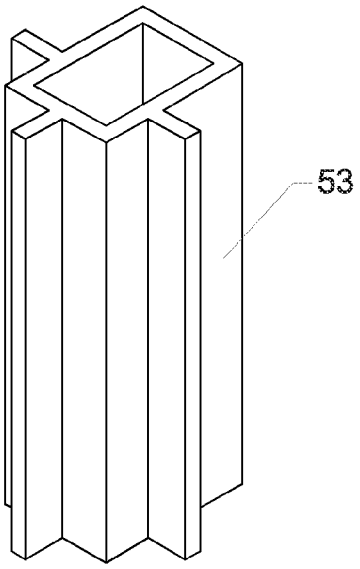
FIG. 12 Joint profile of the construction profile kit in FIG. 11.
Figure 14:
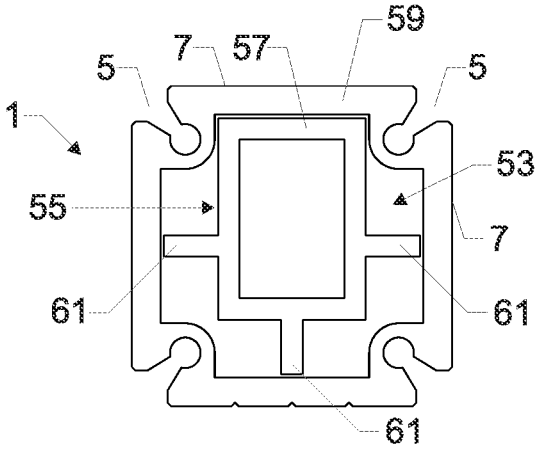
FIG. 14 Section view of the kit shown in FIG. 11.

As shown in FIGS. 11, 12 and 14 an embodiment of a construction profile kit according to the present invention allowing for a quick, precise and stable construction of frames comprises hollow construction profiles 1 as described above and joint profiles 53 being formed so as to be inserted in an end of a respective hollow construction profile 1 and get in abutment with all four inner sides of the face walls of the hollow construction profile. In this particular embodiment the joint profile 53 comprises a rigid rectangular body 55, one side 57 of which fits to an inner side of a face wall 59 and abuts also against the walls of the slots 5 formed in the edge portions of the profile adjacent to the ends of the face wall 59. The other three sides of the body 55 are provided with spreading fins 61 which abut against the other three inner sides of the hollow profile 1.

Figure 13:
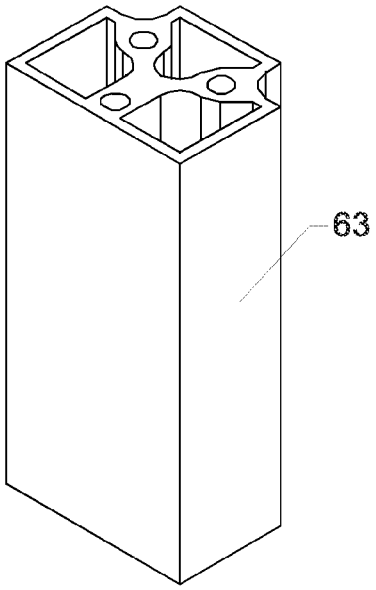
FIG. 13 Alternative joint profile of the construction profile kit.
Figure 15:
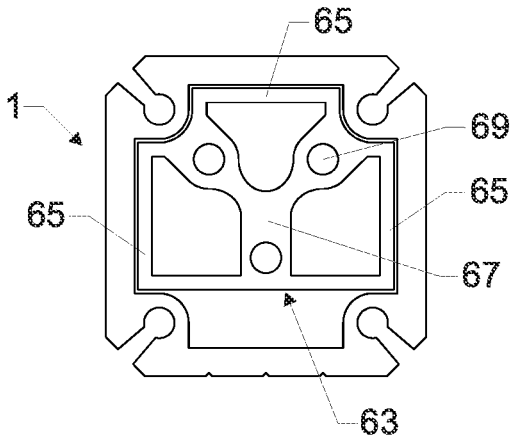
FIG. 15 Section view of a construction profile kit comprising the joint profile shown in FIG. 13.

Another embodiment of the construction profile kit according to the present invention relies on the use of a rectangular body 63 as a joint profile, however without spreading fins as shown in FIGS. 13 and 15. This body has three sides 65 each of which shows the fitting and abutment characteristics of the side 57 explained above with regard to the previous embodiment. The body 63 has a cell structure with reinforcing cell walls 67 ventilated by longitudinal bores 69.

Figure 16:
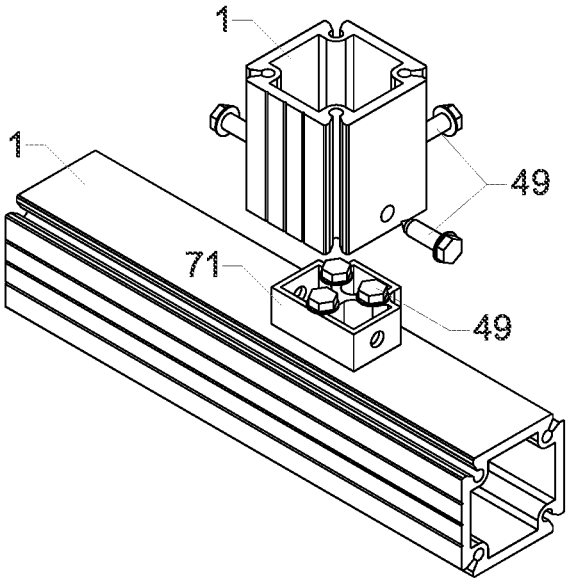
FIG. 16 Another embodiment of a construction profile kit.

In order to set up frames the construction profile kit according to the invention can also comprise a joint element 71 cut as a narrow slice of the body 63 (shown in FIG. 13), fixed to one face of a profile 1 by screws penetrating the bores 69 and inserted in the end of another profile as shown in FIG. 16. For improving the joint stability additional screws 49 can be provided in the same way as shown in FIG. 11.

Figure 9:
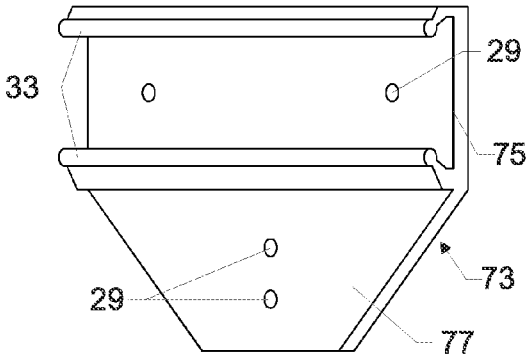
FIG. 9 Another embodiment of the supporting element.
Figure 17:
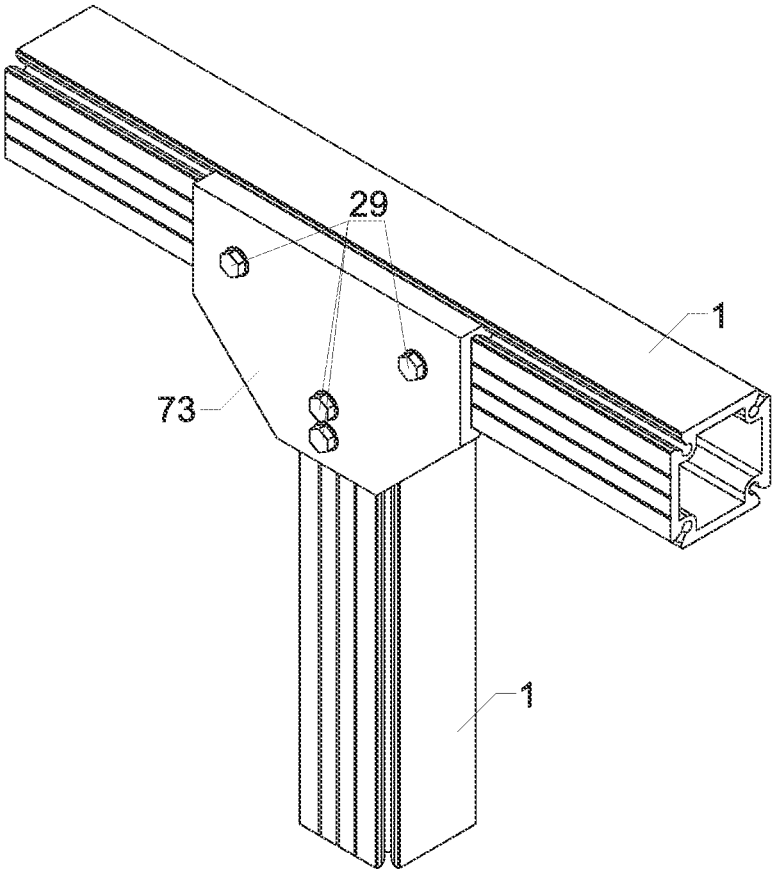
FIG. 17 Another embodiment of a construction profile kit.

Another joint element 73 shown in FIGS. 9 and 17 comprises a first plate portion 75 identical to the front plate portion of the supporting element 21 shown in FIG. 7 and second plane plate portion 77. The first plate portion 75 is slid by means of its keys 33 into two corresponding slots of a first profile 1 while the second plane plate portion 77 is brought in alignment with one of the faces at the end of another profile to be connected to the first profile. Then both plate portions are secured by self-cutting screws 27 to both profiles, respectively, as shown in FIG. 17.

Figure 8:
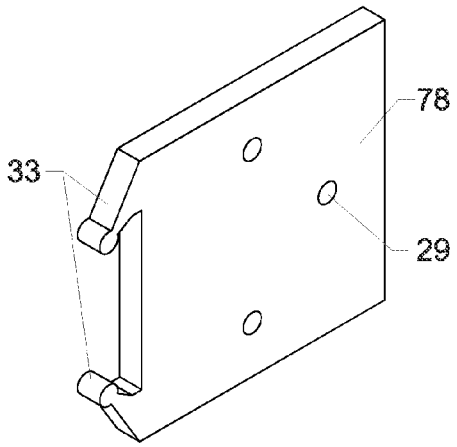
FIG. 8 Another embodiment of the supporting element.
Figure 18:
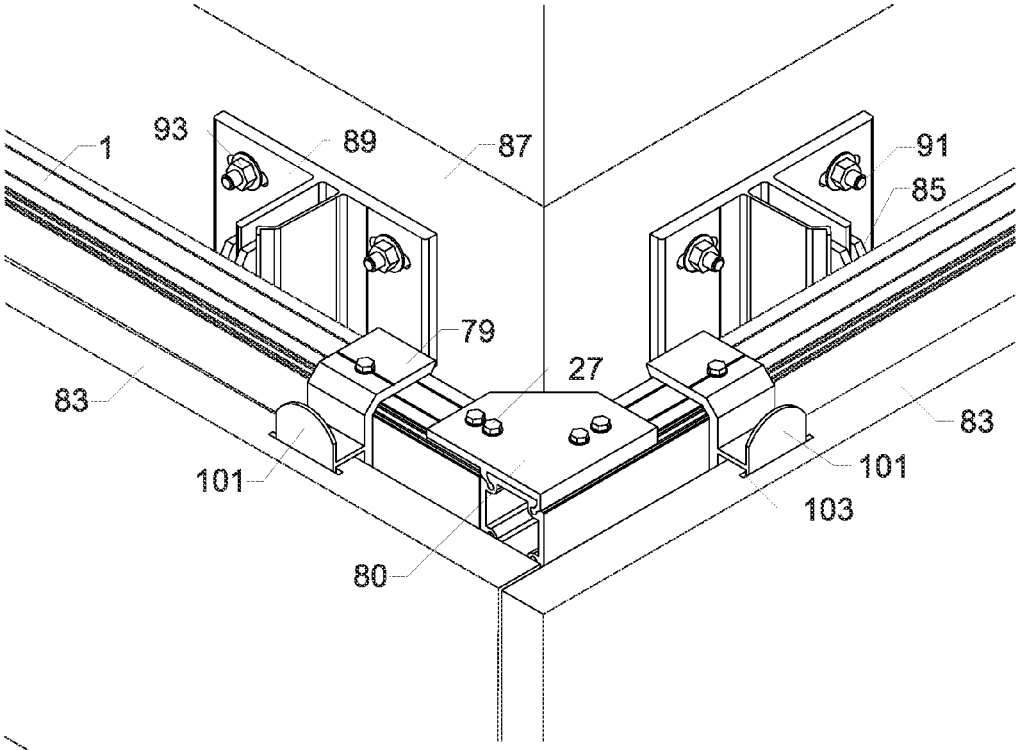
FIG. 18 Another embodiment of a construction set and a fixing system according to the invention.
Figure 19:
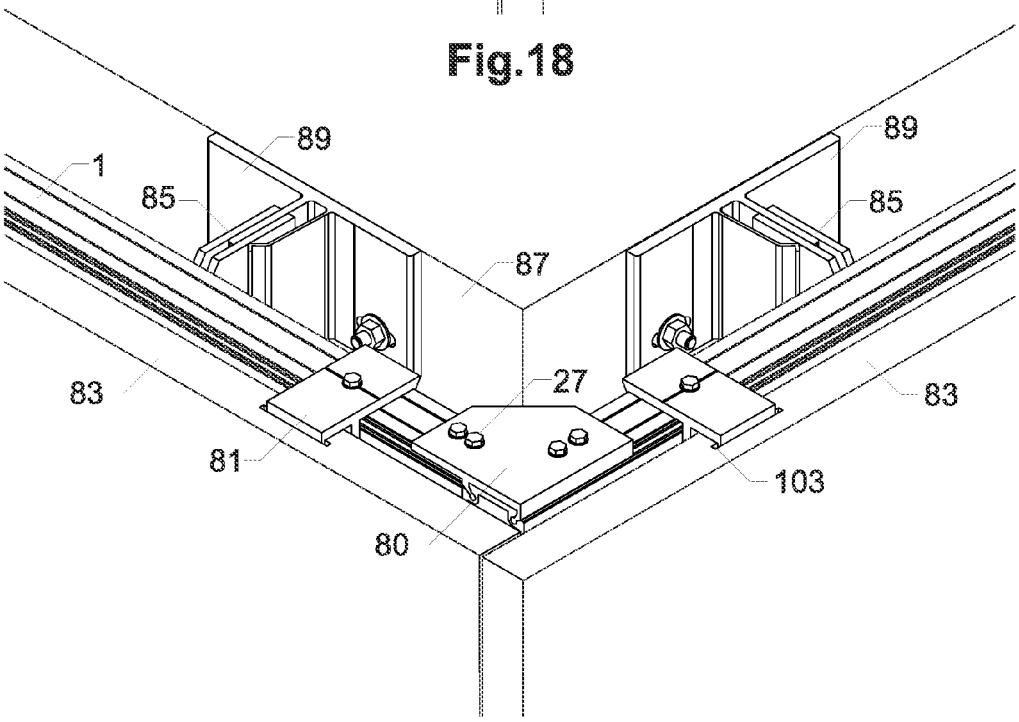
FIG. 19 Another embodiment of a construction set and a fixing system according to the invention.

Similar supporting elements 85 and joint element 85 are shown in FIGS. 8, 18 and 19.

According to the illustration of FIGS. 4, 11, 18 and 19 an embodiment of a fixing system for ventilated facades according to the invention having improved stability, mounting versatility and allowing for a fast and easy assembly and maintenance comprises a supporting frame of construction profiles 1 described above. As illustrated by FIG. 11, the frame of profiles is constructed so that two adjacent profiles (the second one being not shown in the figure) are connected by a joint profile 53 fitted in adjacent end portions of these profiles, so that the profiles share one supporting element 21 which is locked in the slots of the adjacent profiles by the joint profile. Thus, a frame construction having a minimum number of elements and improved stability is achieved.

The fixing system is further provided with holding elements 23, 79, 81 for holding facade plates 83 and supporting elements 21, 85 for supporting the frame to a facade 87. The holding and supporting elements are formed so as to be slid or plugged (clicked-in) into corresponding slots of the construction profiles. The fixing system comprises brackets 89 that receive the supporting elements 21, 85 and are formed so as to be anchored to the facade 87 by bolts 91 and tightening nuts 93. Each bracket has a base portion anchored by said bolts an upright mounting plate portion 94 and an adjacent spring plate 95 having easy-fit end 97 for receiving and clamping a support element before fixing it by rivets 99 to the mounting plate portion 94 as shown in FIG. 4.

As additionally illustrated by FIGS. 5*a*, 5*b*, 6*a*, 6*b*, the holding element 23, 79, 81 has one elongated or two short projections 25 with a tooth-like cross-section fitting only with the tapered opening 9, 13 of the slots of the construction profile 1. This way for example the elongated tooth 25 can be manufactured with generous tolerances with regard to its length, because it can reach to just the beginning of the tapered opening of the slot or all the way to the bottom portion wall of the slot. Also, special care is not necessary when mounting, since the arrangement is self-guiding.

Further each holding element 23, 79, 81 is provided at its front face with one or two disc portions 101 engaging in corresponding slits 103 formed in the circumference of the facade plates 83.

The above fixing system preferably comprises two construction profiles connected by a joint profile fitted in adjacent end portions of these profiles which share one supporting element attached to these end portions. Such an arrangement potentially minimizes the number of supporting elements necessary for the assembly of a supporting frame made of the construction profiles.

The above described construction profile, construction set, construction profile kit and fixing system, are preferably used for ventilated claddings, but their respective use is not limited thereto. Other technical fields include outer or interior decoration, exhibition stand construction, toy construction systems or furniture construction systems, e.g. for the assembly of shelves, tables and chairs.

The invention claimed is:

1. A construction profile comprising:

a polygonal cross-section;

a plurality of polygon faces; and a plurality of slots, each slot being formed at the intersection of adjacent, non-parallel polygon faces of the plurality of polygon faces, each slot including a tapered opening and an inner bottom portion, the tapered opening being defined by at least a pair of opposing planar surfaces, the inner bottom portion forming an undercut behind a narrow end of the tapered opening.

2. The construction profile according to claim 1, wherein the inner bottom portion has a circular shape.

3. The construction profile according to claim 1, the construction profile being formed as a hollow profile comprising a contour wall that in cross section comprises straight portions forming the polygon faces and each of the slots being defined by a clip-like fold of the contour wall between adjacent of the straight portions of the contour wall.

4. The construction profile according to claim 3, wherein, in cross-section, the contour wall has a variable wall thickness in the portions of the contour wall defining the slots, the wall thickness of the contour wall adjacent the inner bottom portions of the slots being less than the wall thickness of the contour wall adjacent the tapered openings and the wall thickness of the contour wall adjacent the polygon faces.

5. A construction set, comprising:

the construction profile according to claim 1; and at least one of a supporting or a holding element(s) configured to engage at least one of the slots of the construction profile while fitting with at least one of the polygon faces of the construction profile which does not comprise one of the slots.

6. A construction profile kit comprising the construction profile according to claim 3 and joint profiles being formed so as to be inserted in an end of the construction profile and abut with inner sides of at least two opposite walls of the construction profile.

7. A fixing system for ventilated facades comprising a frame of construction profiles according to claim 1.

8. The fixing system according to claim 7, further comprising supporting elements for supporting the frame to a facade and holding elements for holding facade plates, the supporting elements and the holding elements being formed so as to be one of slid longitudinally or plugged circumferentially into the slots of the construction profiles.

9. The fixing system according to claim 8, wherein at least one of the supporting and the holding elements comprise at least one elongated tooth portion configured to engage at least one of the slots of the construction profile.

10. The fixing system according to claim 8, wherein the supporting elements comprise two key portions to be slid and plugged into the slots of the construction profile so as to enable a positive locking.

11. The fixing system according to claim 9, wherein the at least one elongated tooth portion of the holding element has a tooth-like cross-section fitting only with the tapered opening of the at least one of the slots of the construction profile.

12. The fixing system according to claim 10, wherein two construction profiles of the construction profiles are connected by a joint profile fitted in adjacent end portions of the two construction profiles, the two construction profiles sharing one common supporting element attached to the adjacent end portions, the common supporting element being one of the supporting elements.

13. A construction set, comprising:

the construction profile according to claim 2, and at least one of a supporting or a holding element(s) configured to engage at least one of the slots of the construction profile while fitting with at least one of the polygon faces of the construction profile which does not comprise one of the slots.

14. A construction set, comprising:

the construction profile according to claim 3, and at least one of a supporting or a holding element(s) configured to engage at least one of the slots of the construction profile while fitting with at least one of the polygon faces of the construction profile which does not comprise one of the slots.

15. A construction set, comprising:

the construction profile according to claim 4, and at least one of a supporting or a holding element(s) configured to engage at least one of the slots of the construction profile while fitting with at least one of the polygon faces of the construction profile which does not comprise one of the slots.

16. A construction profile kit comprising the construction profile according to claim 4 and joint profiles being formed so as to be inserted in an end of the construction profile and abut with inner sides of at least two opposite walls of the construction profile.

* * * * *